US007959544B2

(12) United States Patent
Palmer

(10) Patent No.: US 7,959,544 B2
(45) Date of Patent: Jun. 14, 2011

(54) EXERCISE DEVICE WITH RESISTANCE

(76) Inventor: Dennis D. Palmer, Sandy, UT (US)

( * ) Notice: Subject to any disclaimer, the term of this patent is extended or adjusted under 35 U.S.C. 154(b) by 0 days.

(21) Appl. No.: 12/362,401

(22) Filed: Jan. 29, 2009

(65) Prior Publication Data

US 2010/0190621 A1 Jul. 29, 2010

(51) Int. Cl.
*A63B 21/04* (2006.01)
*A63B 21/02* (2006.01)
*A63B 22/14* (2006.01)

(52) U.S. Cl. ..... 482/130; 482/123; 482/146

(58) Field of Classification Search ..... 482/70, 482/71, 129, 130, 146, 147, 52, 79, 80, 123
See application file for complete search history.

(56) References Cited

U.S. PATENT DOCUMENTS

| | | | | |
|---|---|---|---|---|
| 3,421,760 | A * | 1/1969 | Freeman, Jr. | 482/80 |
| 3,529,818 | A | 9/1970 | Aijala | |
| 3,531,110 | A * | 9/1970 | Marchu | 482/71 |
| 3,547,434 | A * | 12/1970 | Ossenkop | 482/71 |
| 3,638,940 | A * | 2/1972 | Mehaulic | 482/51 |
| 3,650,528 | A * | 3/1972 | Natterer | 482/71 |
| 3,791,645 | A | 2/1974 | Stelma | |
| 3,807,727 | A | 4/1974 | Ferguson | |
| 4,376,532 | A * | 3/1983 | Hunstad | 482/71 |
| 4,607,839 | A * | 8/1986 | Knudson | 482/71 |
| 4,669,723 | A * | 6/1987 | Arsenian | 482/71 |
| 4,744,557 | A * | 5/1988 | Smirmaul | 482/71 |
| 4,799,475 | A | 1/1989 | Iams | |
| 4,993,704 | A | 2/1991 | Luczynski | |
| 4,998,720 | A | 3/1991 | Kim | |
| 5,316,530 | A * | 5/1994 | Romer | 482/71 |
| 5,407,406 | A | 4/1995 | Canela | |
| 5,429,567 | A * | 7/1995 | Gerschefske et al. | 482/70 |
| 5,588,841 | A | 12/1996 | Mechling | |
| 5,607,374 | A | 3/1997 | Hesse | |
| 5,749,811 | A * | 5/1998 | Wilson | 482/71 |
| 5,911,650 | A * | 6/1999 | Cox | 482/70 |
| 6,849,032 | B2 * | 2/2005 | Chu | 482/51 |
| 7,014,595 | B2 * | 3/2006 | Bruno | 482/51 |
| 7,115,073 | B2 * | 10/2006 | Nizamuddin | 482/51 |
| 7,156,786 | B1 | 1/2007 | Palmer | |
| 2006/0046902 | A1 * | 3/2006 | Chang | 482/52 |

FOREIGN PATENT DOCUMENTS

| | | |
|---|---|---|
| JP | 2005-177405 | 7/2005 |
| KR | 10-0405954 | 11/2003 |
| KR | 20-0397823 | 10/2005 |

OTHER PUBLICATIONS

PCT Application PCT/US2010/022499; filed Jan. 29, 2010; Dennis D. Palmer; ISR mailed Oct. 11, 2010.

* cited by examiner

*Primary Examiner* — Allana Lewin
(74) *Attorney, Agent, or Firm* — Thorpe North & Western LLP

(57) ABSTRACT

An exercise device is provided which comprises a base configured to support the exercise device, an arcuate path extending from the base, a limb support configured to receive a limb of a user and which moves along the arcuate path, and a resistance member attachable to the limb support and configured to provide resistance against movement of the limb support along the arcuate path.

2 Claims, 3 Drawing Sheets

EXERCISE DEVICE WITH RESISTANCE

BACKGROUND

Exercising devices for strengthening muscles related to the lower extremities are beneficial to individuals desiring exercise. However, many large floor-associated exercise devices for thighs are expensive and lack portability. Although smaller, portable thigh exercise devices have been developed, they have limitations. Notably, such exercise devices usually are capable of exerting forces in only a single lateral direction. As a result, these exercise devices do not permit the user to strengthen thigh muscles uniformly. Additionally, such exercise devices are limited in ranges of motion and can only strengthen the muscles along that range of motion.

There is a need for an exercise device for thighs and the like which is small, easily stored and portable, and which is effective for uniformly strengthening thigh muscles and for strengthening muscles along a range of motion not targeted by other exercise devices.

SUMMARY OF THE INVENTION

An exercise device is provided which has a base configured to support the exercise device and an arcuate path extending from the base. Limb supports can move along the arcuate path and a resistance member, attachable to the limb support, can provide resistance against movement of the limb support along the arcuate path. In one embodiment, a pair of limb supports is supported about pivot axes attached to the base, and associated with each limb support is an elastic member attachable to the respective limb support, and which passes through a sheave coupled to the base.

Additional features and advantages of the invention will be apparent from the detailed description which follows, taken in conjunction with the accompanying drawings, which together illustrate, by way of example, features of the invention.

DETAILED DESCRIPTION OF EXAMPLE EMBODIMENT(S)

Figure 1:
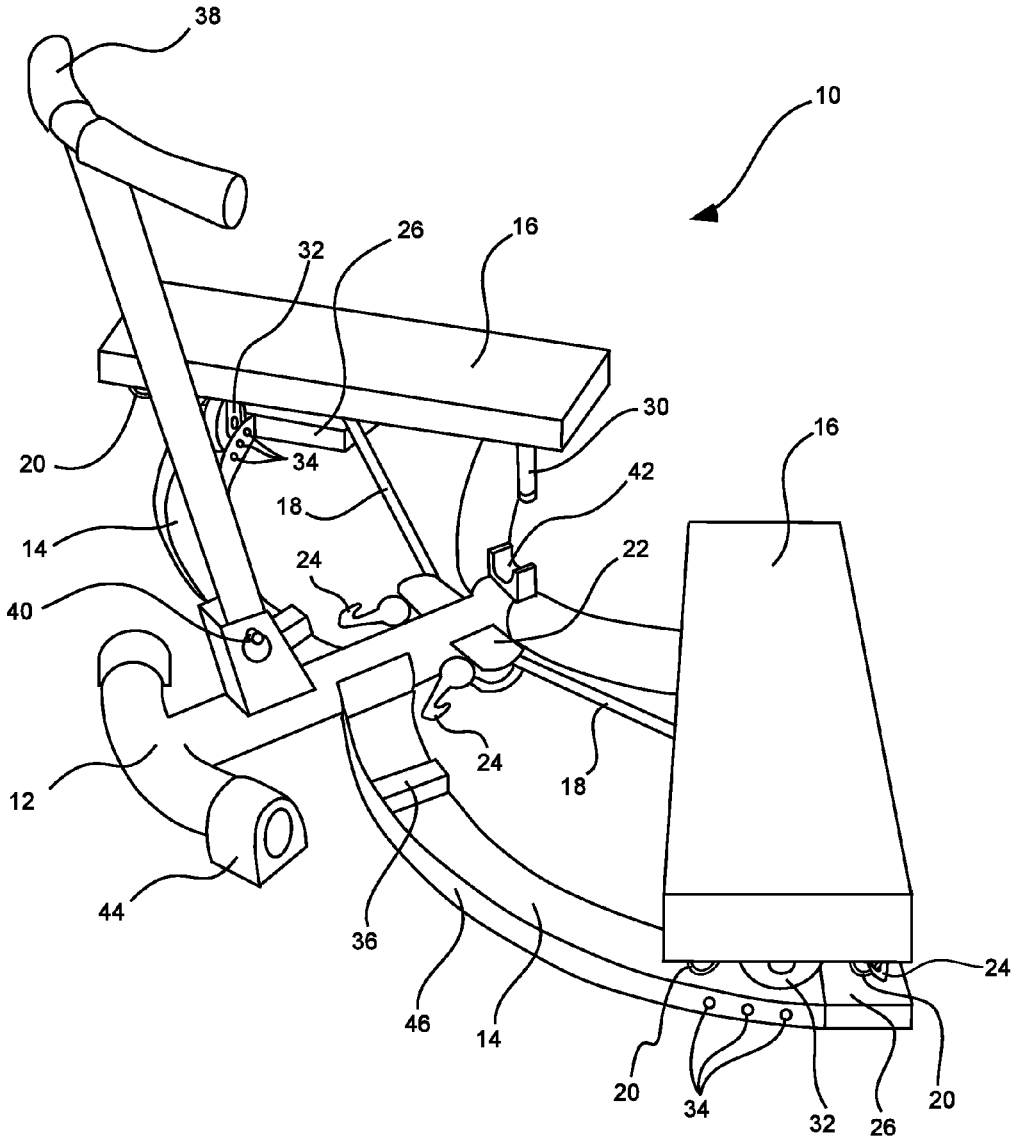
FIG. 1 is a perspective view of an exercise device in accordance with an embodiment of the present invention.

It has been recognized that it would be advantageous to provide a portable, inexpensive exercise device which is easily and readily used in exercising the thighs and buttocks of the user, and which provides resistance.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
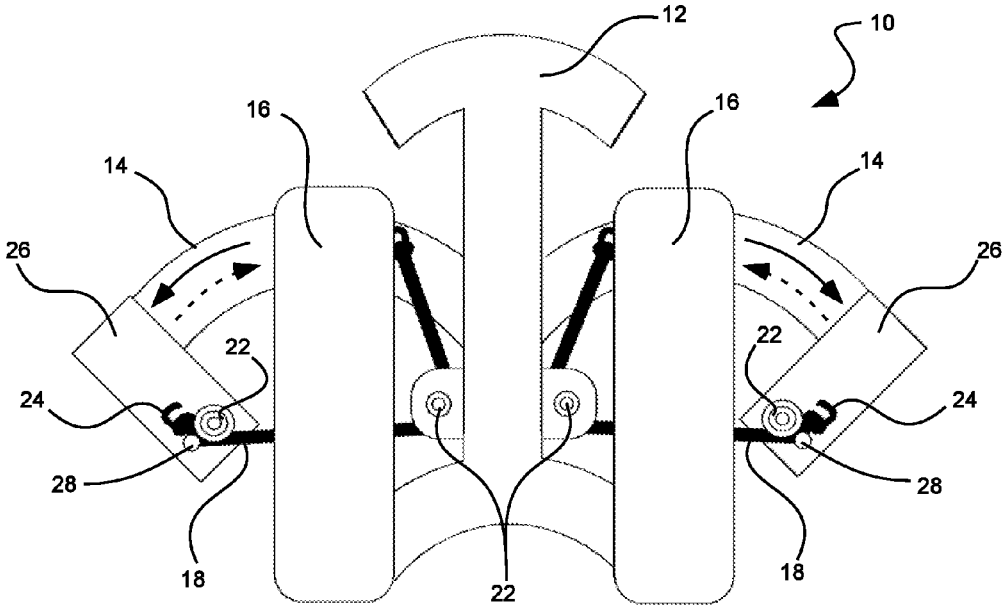
FIG. 2 is a top view an exercise device in accordance with an embodiment of the present invention.
Figure 3:
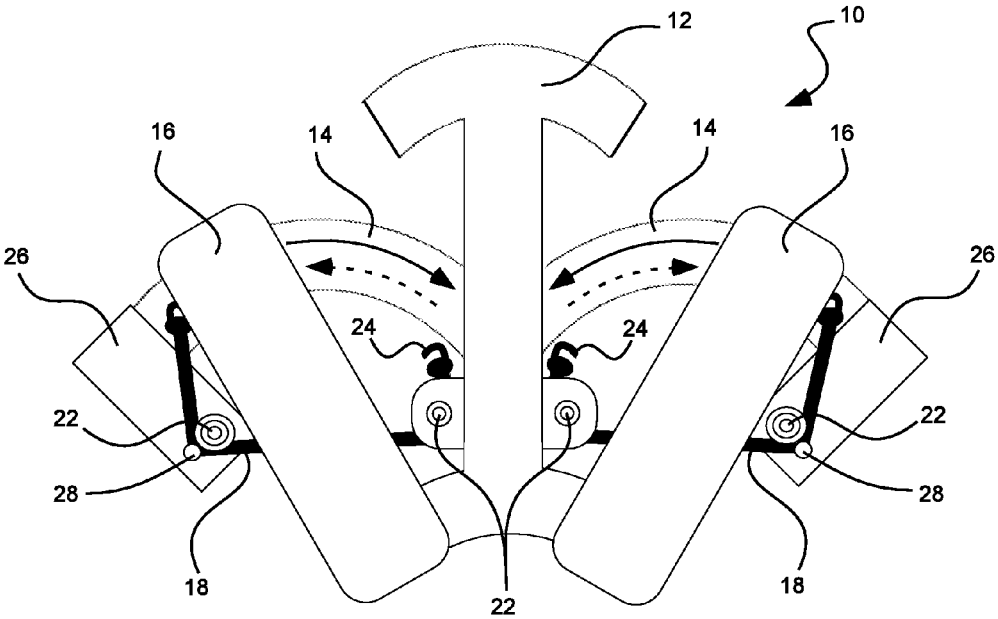
FIG. 3 is a top view of an exercise device in accordance with an embodiment of the present invention.

As illustrated in FIGS. 1-3, an exercise device, indicated generally at 10, in an example implementation in accordance with the present invention is shown for exercising thighs and buttocks with multiple resistance directions. The exercise device 10 includes a base 12 which supports the exercise device 10. The base 12 can be any variety of shape or form suitable to support the device 10. The base 12 shown in the figures is but one example embodiment of a base design that requires a reduced amount of floor space and provides an aesthetically pleasing design. The base 12 can be formed of any type of material suitably sturdy enough to support a user during exercise. Such materials can include, but are not limited to, metal, wood, plastic, or composite materials. In one aspect, the base 12 can be formed of a hollow, tubular steel construction to provide a strong and sturdy base of relatively light weight. The base 12 can include feet or pads on an underside of the base 12, which can be made from a material such as rubber or plastic, to prevent slippage of the base 12 along a surface and to prevent damage to the surface. Additionally, in embodiments where the base 12 is formed from a hollow tubular member, it may be desirable to include a cap 44 or end piece, which can be made from a material such as rubber or plastic, on open ends of the tube to cover potentially sharp edges and prevent debris or the like from entering into the tube. A bottom side of the cap 44 can serve a similar function to the feet or pads which can be placed on the underside of the base 12. In one aspect, the bottom side of the cap is corrugated to better prevent slippage along a surface.

The exercise device 10 includes an arcuate path 14 which extends from the base 12. The arcuate path 14 can be a physical member of the device 10, as shown in the figures, or in other embodiments, the arcuate path 14 may not be a physical member of the device 10 but a path defined by movement of a limb support 16 as the limb support 16 pivots on a pivot axis 30. In embodiments where the arcuate path 14 is a physical member of the device 10, the arcuate path 14 can be made from a material suitable to support movement of the limb support 16 along the arcuate path 14. Such material may be a same or similar material to that used to form the base 12. In one aspect, the arcuate path 14 may be formed as a substantially flat arcuate piece of steel. The arcuate path 14 may be attached to the base 12 by methods such as welds, clamps, bolts, glues, nails, or any other method as would be apparent to one skilled in the art, and as would suitably attach the arcuate path 14 to the base 12 depending on the materials from which they are formed. The arcuate path 14 may be substantially horizontal, or may be inclined along at least a portion of a length of the arcuate path. In one aspect, the arcuate path 14 is attached to the base 12 in such a manner as to allow variable inclination of the arcuate path 14, such as by a hinge. Inclination of the arcuate path 14 may provide additional resistance for exercises.

In one aspect, the arcuate path 14 can be formed from a flat arcuate piece of metal with an edge folded or bent upwards as a flange 46 at approximately 90°. This configuration provides multiple benefits. One benefit is the flange 46 can further define the arcuate path 14 as a track for the motion of the limb support 16. Another advantage is that this configuration allows apertures 34 to be formed in the flange 46 which can serve to anchor a resistance member 18 which provides resistance to movement of the limb support 16 along the arcuate path 14. In example embodiments, the resistance member 18 may be an elastic member providing elasticated resistance, a metal coil spring, or other resistance that will be discussed more later. Also, said apertures 34 may serve to vary a length of the arcuate path 14. As shown in FIG. 1, apertures 34 maybe formed in a flange 46 on both arcuate sides of the arcuate path 14, and may be formed such that an aperture 34 on one side of the arcuate path 14 corresponds to an aperture 34 on the opposite side of the arcuate path 14. In this manner, a rod or other suitable device could be inserted through corresponding apertures 34 to prevent the limb support 16 from moving further in that direction along the arcuate path 14. This effectively limits or varies the length of the arcuate path 14 and may allow for targeting exercise of muscles within a more specific range of motion. It is understood that such a configuration for varying a length of the arcuate path 14, while shown only on the outward edges of the arcuate path 14, could be implemented at any point along the arcuate path 14.

In one embodiment, the arcuate path 14 includes a stop 36 to provide an effective endpoint for the arcuate path 14, or a point past which the limb support 16 cannot move. The stop 36 can be formed of any suitable material. In one aspect, the stop 36 is formed of folded steel and can include a cap on an open end to protect a user from potentially sharp edges and prevent debris and the like from entering into the hollow stop 36. The stop 36 can be permanently affixed to the arcuate path 14 to provide a secure stopping point for the limb support 16. In one aspect, the stop 36 can be positioned to provide stopping point for the limb support 16 where the limb support 16 is parallel with another limb support 16, as shown in FIG. 2 (stop 36 not shown). Other alternatives for the stop include using the base 12 itself as a stop, or utilizing a removable stop which can be positioned at various positions along the arcuate path 14, such as by utilizing the apertures 34, to provide a variable path length. In embodiments comprising multiple limb supports 16, it may be desirable to use a removable stop 36, a pin through the apertures 34, or other means for holding one of the limb supports 16 in place in order to better exercise using only a single limb support 16. Likewise, the removable stop 36 or other such means maybe used to hold one or more limb supports 16 in a particular position for storage or transportation.

The exercise device 10 may further include a block 26 at the ends of the arcuate path 14 distal from the base 12. The block 26 can serve to block or stop further movement of the limb support 16 along the arcuate path 14 in the direction similar to the above-described stop 36. In one aspect, the block 26 can be formed of the same material as the arcuate path 14, such as steel. To reduce weight, the block can be hollow and may be formed as a three-dimensional rectangle or block-like object.

The exercise device 10 includes at least one limb support 16. The limb support 16 may be configured to support various portions of various limbs such as upper or lower arms or legs, or hands or feet, in order to exercise the various muscles of the different portions of different limbs. It is understood that while the figures show two limb supports 16, embodiments are contemplated where the exercise device 10 includes fewer or greater than two limb supports 16. In one aspect, the limb support 16 may be configured to support a tibial or shin region of a user's leg. A user may kneel on the limb support 16 with the knee near an end of the limb support which moves along the arcuate path 14 and the foot near the opposite end of the limb support. It is also contemplated that a user may wish to use the limb support 16 to support other limb regions as well, such as knees, feet, arms, hands, or regions which could be used in exercising with the exercise device 10.

The limb support 16 may be formed of any material suitably sturdy to support a user. In one aspect, the limb support 16 is formed by providing a wooden base portion, disposing a foam or other cushioning material on the wooden base, and surrounding the wooden base and cushioning material with a cover. The cover may be any suitable material and may include vinyl, cotton, polyester, rubber, or other materials. It may be desirable to use a material which provides a certain amount of grip between the limb support 16 and a user's limb to minimize slippage of the limb on the limb support 16 during use. In one aspect, edges of a long dimension of the limb support 16 may be raised with respect to a center of the limb support 16 so as to provide an indentation, trough, or recess for receiving a user's limb to provide enhanced comfort and reduced slippage.

The limb support 16 can be configured to move along the arcuate path 14, as described above. In one aspect, the limb support 16 can pivot on a pivot axis 30 which can be attached to or formed integrally with a portion of the base 12. It can be pivoting of the limb support 16 on this pivot axis 30 which defines the arcuate path 14 which is not a physical member of the exercise device 10 as described in one example embodiment above. In embodiments where a sufficiently sturdy pivot axis 30 is provided, the entire limb support 16 can be supported on this pivot axis 30. Ends of the limb support 16 distal from the pivot axis 30 may thus move freely through the air above a surface upon which the exercise device 10 rests. Either the base 12 or the limb support 16 can have structure attached thereto to stop movement past a certain point in a manner similar to the stop 36 or the block 26 described above. In one aspect, the pivot axis 30 may have a mechanism for varying a degree of resistance against pivoting of the limb support 16. This mechanism may be a form of a brake which is variably applicable to provide more or less resistance against movement according to a user's selection.

In another embodiment, the mechanism for providing resistance against movement of the limb supports along the arcuate path may be a rubber pivot member located at the pivot axis and attached to the limb support and the base, such that when the limb support is rotated on the pivot axis, the rubber pivot member is twisted providing resistance against the twisting movement and urging the limb support back to an original position after such twisting movement.

In one aspect, the pivot axis can be attached to a back end of the base 12 such that if a user kneels on the limb support 16 a knee end of a tibial or shin portion of the leg changes position and moves along the arcuate path 14 while an ankle end of the tibial or shin portion of the leg merely rotates while staying in substantially the same position. In another aspect, the pivot axis can be attached to a front end of the base 12 such that if a user kneels on the limb support 16 an ankle end of a tibial or shin portion of the leg changes position and moves along the arcuate path 14 while a knee end of the tibial or shin portion of the leg merely rotates while staying in substantially the same position. By changing the pivot axis a degree of resistance provided by the resistance member 18 may be changed, and/or a pivoting end of the limb support 16 can be changed between back and front.

In other embodiments, the end of the limb support 16 distal from the pivot axis 30 is supported by a wheel 32, roller, caster, or the like. The wheel 32 can be attached to an underside of the limb support 16 and can be configured to roll along the arcuate path 14 as the limb support 16 pivots on the pivot axis 30. In one aspect, a framework connecting the wheel 32 to the limb support 16 can be configured to prevent the wheel 32 from turning to either side as the wheel 32 rolls. Allowing the wheel to turn to the side may present difficulties to a user if a wheel is turned sideways when a user is attempting to exercise using the device 10. It is understood that a track may be designed to prevent such difficulties, and such a track may increase the cost or weight of the device 10. In embodiments where the arcuate path 14 is not a physical member of the exercise device 10, the wheel 32 may be configured to roll along the surface upon which the exercise device 10 rests. In other embodiments where the arcuate path 14 is a physical member of the exercise device 10, the wheel 32 may be configured to roll on top of and along the arcuate path 14 which is attached to the base 12. In one aspect the wheel 32 may have a mechanism for varying the degree of resistance against rolling of the wheel 32. This mechanism may be a form of a brake which is variably applicable to provide more or less resistance against movement according to a user's selection.

In one embodiment, the exercise device 10 does not include a pivot axis and both ends of the limb support 16 are supported by casters, wheels, rollers, or the like. Either the base 12 or the arcuate path 14 can provide a track along which the limb support 16 can move. In one aspect, the exercise device 10 can include two arcuate paths, one for each end of the limb support 16. In this configuration, the limb support 16 does not rotate on a fixed axis like the pivot axis embodiments described above, but the entire limb support 16 can move back and forth across the arcuate paths and against elasticated resistance.

The exercise device 10 includes a resistance member 18 configured to provide resistance against movement of the limb support 16 along the arcuate path 14. In one embodiment, the resistance member 18 may be an elastic member 18 providing elasticated resistance. The elastic member 18 can be formed of rubber or any other material with suitable elastic properties. The elastic member 18 may comprise a rubber or other elastomeric material sheathed by a continuous weave of braided fibers or filaments. The weave can be flexible, stretchable, and can add strength to the elastic member 18 at a minimal cost. In one aspect, the elastic member 18 can be retained by or anchored to the base 12. The elastic member 18 can be attachable to connection points 20 on the limb support 16. Connection points 20 can be located on either side of the limb support 16. The limb support 16 may have multiple connection points 20 on either side to provide differing elasticated resistance based on where the elastic member 18 is connected to the limb support 16. The elastic member 18 may be attachable to the connection points 20 by various means known or apparent to those skilled in the art, such as hook and loop, knot, clamp, clip, snap, or other means. In the embodiments shown in the figures, the elastic member 18 includes a hook 24 on each end. At connection points 20, underneath the limb supports 16, are loops configured to receive the hook 24. In this manner, the elastic member 18 is configured to be easily and quickly attachable or detachable to connection points 20 on the limb support 16.

The resistance member 18 can be directly retained by and coupled to the base 12, and can form a direct connection between the base 12 and the limb support 16. Alternatively, the resistance member 18 may retained by a sheave 22 coupled to the base 12. The sheave 22 forms a pulley system in combination with the resistance member 18, and can have numerous advantages. The pulley system can distribute force along the resistance member 18 and enable the same resistance member 18 to be used in multiple positions and configurations. It is understood that a hook, keeper, loop or other form of non-rotatable structure may serve a similar purpose to the sheave 22, but may create more friction and can prematurely wear down the resistance member 18 and/or the protective sheath surrounding the resistance member 18.

In one embodiment, the exercise device 10 can include a sheave 22 on the block 26. The sheave 22 can be coupled to the block 26, such as by a bolt, in a manner that allows the sheave 22 to rotate. Adjacent the sheave 22 on the block 26 can be a rod 28 or other suitable structure for holding the elastic member 18 within a groove of the sheave 22. As shown in FIG. 2, the rod 28 can be configured to prevent a hook 24 end of the elastic member 18 from passing through the groove. The exercise device 10 may also include a sheave 22 coupled to the base 12. The base 12 can include a housing or other structure to receive the sheave 22. As shown in FIG. 3, a groove of the sheave 22 can be configured to receive the elastic member 18 there through, but the sheave 22 and/or sheave housing can be configured to not allow an end of the resistance member 18 to pass through (see FIG. 3).

In one aspect, the resistance member 18 can be attached to the limb support 16 on one end and anchored to the base 12 at another end to provide resistance against movement of the limb support 16 along the arcuate path 14. The direction of resistance against the limb support 16 can be determined by which end of the resistance member 18 is attached to the limb support 16. FIGS. 2-5 depict arrows indicating movement of the limb support 16 along the arcuate path 14. The solid line arrows indicate movement of the limb support 16 in a direction against the resistance, and the dashed line arrows indicate movement of the limb support 16 in a direction towards which the limb support 16 is pulled by the resistance member 18.

A user can selectively attach ends of the resistance member 18 to the limb support 16 to provide resistance in the desired direction. The resistance member may be configured to pass through the sheave. In a configuration where a first end of the resistance member is anchored to the base and a second end of the resistance member is attached to the limb support, the second end of the resistance member may be detached from the limb support to allow the first end of the resistance member to attach to the limb support while the second end of the resistance member is anchored to the base. In FIG. 2, the resistance member 18 has been attached to connection points on facing inner edges of limb supports 16 to provide resistance against pivoting the limb supports 16 outward from each other.

In FIG. 3, the resistance member 18 has been attached to connection points on outer edges of limb supports 16 to provide resistance against pivoting the limb supports 16 in an inward motion toward each other. Other configurations may include attaching the resistance member 18 to an inner connection point on one limb support 16 and attaching another resistance member 18 to an outer connection point on a second limb support 16 to move the limb supports 16 together in a similar direction while simultaneously exercising a different group of muscles on each limb being used.

Figure 4:
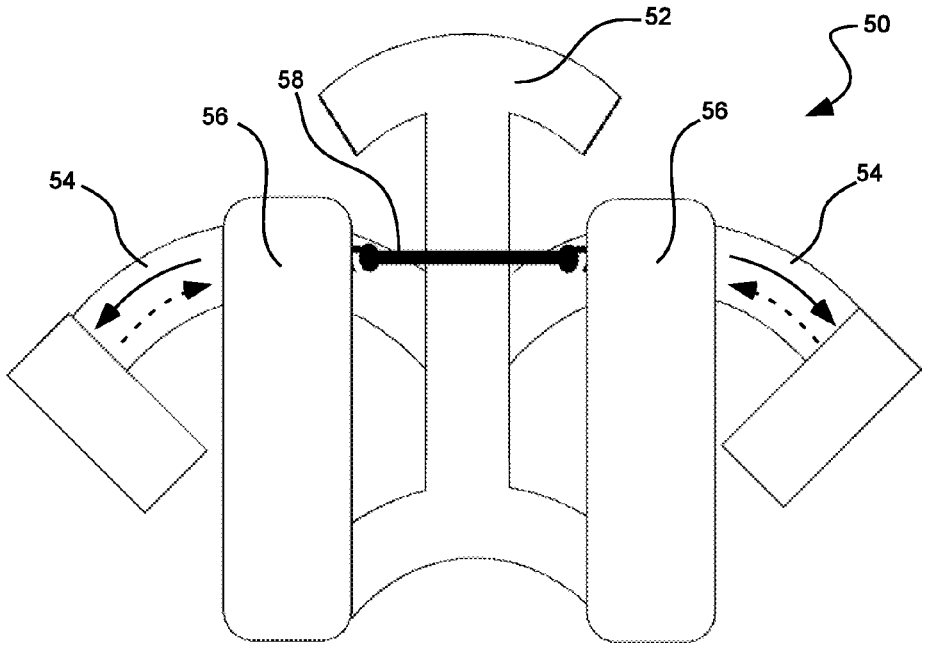
FIG. 4 is a top view of an exercise device in accordance with an embodiment of the present invention.
Figure 5:
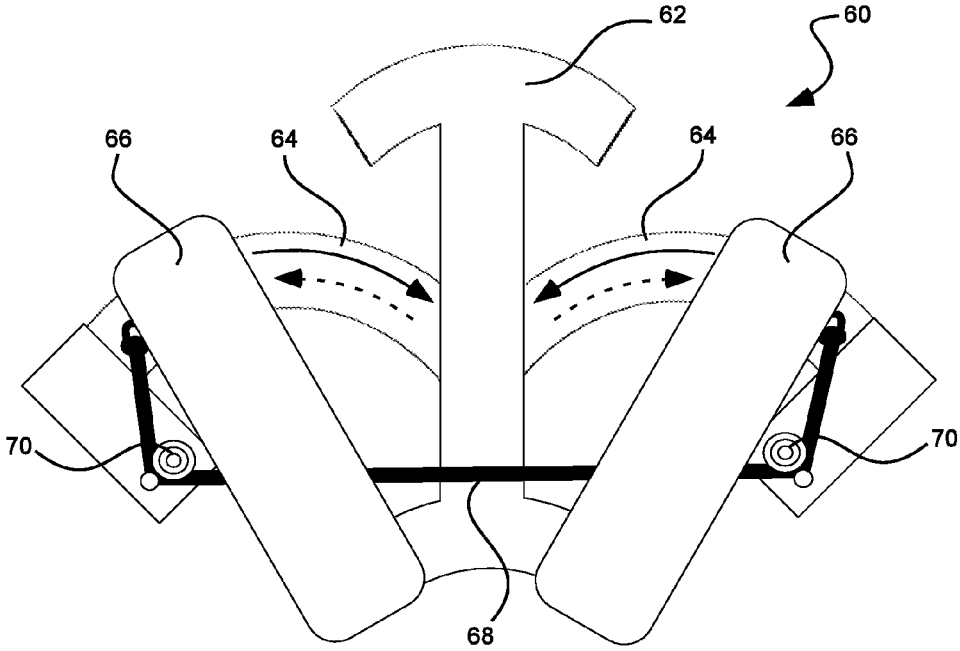
FIG. 5 is a top view of an exercise device in accordance with an embodiment of the present invention.

As illustrated in FIG. 3, one end of a resistance member 18 may be attached to a first connection point on the limb support 16 and a second end of the resistance member 18 may be attached to a second connection point of the same limb support 16. To provide resistance against movement, a point on the resistance member 18 can be held firmly in place by a clamp or other means. In this manner the resistance member 18 can provide resistance in multiple directions using a single resistance member 18 on a single limb support 16. In one embodiment, the resistance member may be an elastic member. A variation of this embodiment includes using multiple elastic members, one having an end attached to a first connection point on a limb support 16 and the other having an end attached to a second connection point on an opposite side of the limb support 16. The elastic members can be anchored to the base 12. In this manner, the exercise device 10 can provide resistance in multiple directions using multiple elastic members on a single limb support 16. FIGS. 4 and 5 depict other possible configurations of the exercise device. FIG. 4 depicts an exercise device 50 in accordance with one embodiment of the present invention, wherein a single elastic member 58 is not anchored to or retained by the base 52 but is only attached to connection points at opposing inner ends of limb supports 56. Such a configuration provides elasticated resistance in a direction along the arcuate path 54 similar to the direction shown in FIG. 2. FIG. 5 depicts an exercise device 60 in accordance with one embodiment of the present invention, with a base 62 and wherein a single elastic member 68 is retained by sheaves 70 and is attached to connection points on outer edges of limb supports 66 to provide elasticated resistance in a direction along the arcuate path 64 similar to the direction shown in FIG. 3.

In one aspect of the present invention, a degree of resistance may be varied through one or more of differing methods. The degree of resistance may be varied by varying a position on the base 12 where the resistance member 18 is anchored or retained. For example, the resistance member 18 may be anchored to the base 12 by the sheave 22 as described above and shown in the figures. Alternatively, the resistance member 18 may be anchored to the base 12 by attaching an end of the resistance member 18 to the base 12. In one aspect, the resistance member 18 can be anchored to the base 12 by inserting the hook 24 through apertures 34 on the arcuate path 14. Varying the position on the base 12 where the resistance member 18 is anchored stretches the resistance member 18 differing degrees resulting in differing resistance against movement of the limb support 16 along the arcuate path 14. Another method for varying the degree of resistance is to vary a length of the resistance member 18. Other methods for varying the degree of resistance are to interchange the resistance member 18 with a different resistance member having a different resistance, or to add a second resistance member to use in tandem with the first resistance member 18 to increase resistance.

Other embodiments for providing resistance are also contemplated. As described above, resistance may be provided through a brake or other friction device associated with the wheel or the pivot axis. Resistance may be through a rubber pivot member or through an elastic member. Other forms of resistance which may be utilized with the present invention include, but are not limited to, a coil spring, leaf spring, metal spring, compression of rubber, or friction. For instance, a spring, such as a metal coil spring, may be coupled to the base and the limb support in one or more locations. Resistance may also be achieved by placing a rubber member or multiple rubber members in the path of the wheel or the limb support such that the rubber member is compressed when a user moves the limb support in one direction along the path. Then as the limb support is moved along the path in the opposite direction, the rubber member is decompressed. In the alternative, the system can be configured such that the rubber member is stretched as the limb support moves along the arcuate path. This can provide a spring-like resistance much like the spring or elastic member described above. Friction may be added to the arcuate path to provide yet another form of resistance, such as by varying the texture of the path, using friction fit parts, or placing materials having different textures on the path. In one aspect, a resistance may be provided using a combination of the forms of resistance described herein.

In one embodiment of the present invention shown in FIG. 1, the exercise device 10 can include a handle 38 to support a user while exercising. The handle can be coupled to and extend from the base 12. In one aspect, the handle is removable. The handle can be pivotally attached to the base 12 so as to be repositionable from a first, substantially upright position to a second, substantially horizontal position. The exercise device 10 can further include a pin 40 which can be inserted through a stem of the handle and a portion of the base 12 to securely hold the handle 38 in an upright or folded, compact position. The pin 40 can optionally include a ring to allow a user to more easily grasp and pull the pin out when pivoting the handle 38. The base 12 can further comprise a saddle 42 for receiving the stem of the handle. In one aspect, the pin 40 can be removed from the position shown in FIG. 1 to allow the handle 38 to pivot and can be inserted through the saddle 42 and an aperture in the stem of the handle 38 to securely hold the handle 38 in the folded position.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An exercise device for exercising lower limb muscles, comprising:

a base configured to support the exercise device;

a substantially horizontal arcuate path attached to the base;

a plurality of limb supports which rotate circularly along the substantially horizontal arcuate path upon pivot axes on the base; and a pulley comprising:

an elastic member, removably and directly attached at a first end to a first connection point on a first side of one of the limb supports and further comprising a second end removably attached to a second connection point proximate to a second side of the one of the limb supports, configured to provide elasticated resistance against movement of the limb support along the substantially horizontal arcuate path; and a sheave, coupled to the base, around which the elastic member at least partially extends;

wherein a direction of elasticated resistance is changed when the first end of the elastic member is detached from the first connection point on the first side of the one of the limb supports and is attached proximate to the first side and the second end of the elastic member is directly attached to a third connection point on the second side of the one of the limb supports.

2. An exercise device in accordance with claim 1, further comprising a handle extending from the base.

* * * * *